US005690037A

United States Patent [19]

Hill

[11] Patent Number: 5,690,037

[45] Date of Patent: Nov. 25, 1997

[54] LIGHTWEIGHT FOLDABLE PALLET AND RELATED LIFTING APPARATUS

[76] Inventor: Melvin B. Hill, 408 Arbor Ridge Rd., Stone Mountain, Ga. 30087

[21] Appl. No.: 493,673

[22] Filed: Jun. 22, 1995

[51] Int. Cl.[6] ..... B65D 19/00

[52] U.S. Cl. ..... 108/51.3; 108/51.1

[58] Field of Search ..... 108/51.3, 51.1, 108/56.1, 54.1, 901

[56] References Cited

U.S. PATENT DOCUMENTS

| | | | |
|---|---|---|---|
| 2,643,080 | 6/1953 | Vogel | 108/51.3 |
| 2,774,490 | 12/1956 | Strong | 108/51.3 X |
| 3,026,078 | 3/1962 | Simkins | 108/51.3 |
| 3,036,802 | 5/1962 | Kitchell | 108/51.3 |
| 3,112,715 | 12/1963 | Callahan et al. | 108/51.3 |
| 3,626,860 | 12/1971 | Blatt | 108/51.3 |
| 3,858,526 | 1/1975 | Lombard et al. | 108/51.1 X |

*Primary Examiner*—José V. Chen

*Attorney, Agent, or Firm*—Jones & Askew

[57] ABSTRACT

A pallet having a substantially inelastic flexible load-supporting platform and a plurality of support blocks for maintaining the platform above a ground support. To transport the pallet and its load from place to place, a lifting assembly has a pair of forks for fitting in channels between the support blocks. The forks are laterally extendable with respect to each other, so that a side of each fork can engage a facing side of a support block to maintain the support block and a load thereon in a substantially upright position.

2 Claims, 4 Drawing Sheets

LIGHTWEIGHT FOLDABLE PALLET AND RELATED LIFTING APPARATUS

FIELD OF THE INVENTION

This invention relates in general to apparatus for supporting and lifting loads, and relates in particular to improvements in pallets and related lifting apparatus.

BACKGROUND OF INVENTION

Conventional hard pallets are widely used for storing and moving various objects. Those pallets generally have the shape of a low platform having an upper surface for supporting a load. These pallets usually are made of wood, although hard pallets made of suitable plastic or other materials also are known in the art. The pallets are constructed or formed with openings to receive the tines of a conventional forklift, for lifting and transporting palleted loads. The typical wooden pallet weighs about 40 to 50 pounds unloaded and thus is not easily moved or stacked by an unassisted worker. Moreover, wooden pallets produce hazardous splinters or fragments when the pallets become damaged.

Manufacturers may load a number of individual articles or commodities onto a pallet and then fulfill orders for those commodities by shipping the customer one or more pallets so loaded. When the palleted shipment arrives at the customer's place of business, the loaded pallets are removed from the manufacturer's or shipper's truck or other conveyance. The individual articles usually remain on the pallets at that time, and are removed only later in response to need. For example, high-volume retail garden outlets will purchase large amounts of commodities such as fertilizer or lawn seed, which are delivered in stacks of bags loaded onto pallets. These palleted loads are removed from the delivery vehicle, and individual bags thereafter are removed from the pallets to fill individual purchasers. After the last bag or other package is removed from the pallet, the empty pallet usually is set aside for return to the supplier of the commodities. That return usually will not take place until the next time that particular supplier delivers more product to the particular retail outlet, at which time the accumulated empty pallets should be loaded onto the truck for return to the supplier after unloading another supply of palleted articles from that truck.

Suppliers of palleted products thus need a supply of pallets sufficient to meet not only their ongoing production and shipping requirements, but also to fill a "pipeline" of pallets in transit to their customers, pallets awaiting unloading or empty but awaiting return at the customer's premises, and pallets in transit back to the supplier. Moreover, the pallet user can expect a significant number of pallets to disappear from that round-trip pipeline, for reasons such as loss or misdelivery of the unloaded pallets, damage during handling and storage of the empty pallets, or occasional outright theft of pallets. Furthermore, handling and storing a quantity of individual empty pallets received from a variety of suppliers can present difficulties due to their weight and physical size. As a result, manufacturers and shippers face a considerable expense in providing enough pallets for an ongoing distribution pipeline, and for replacing the pallets that fail to return through the pipeline.

SUMMARY OF INVENTION

It is an object of the present invention to provide an improved pallet.

It is another object of the present invention to provide a pallet that is made of a material other than wood or plastic.

It is a further object of the present invention to provide a pallet that is relatively easily handled and stored when not loaded.

It is still another object of the present invention to provide a pallet that is foldable to a reduced size when unloaded.

It is yet another object of the present invention to provide a pallet that weighs substantially less than the conventional hard pallet.

It is a further object of the present invention to provide a pallet that is foldable to a predetermined size and shape when unloaded, so that the folded pallets are easily and inexpensively returnable for further use.

It is another object of the present invention to provide a lightweight foldable pallet that supports a load above ground, thereby providing space beneath a load support for positioning the forks of a lifting device.

Stated in somewhat general terms, pallets according to the present invention have a load-receiving platform formed of a flexible and substantially inelastic material. The upper surface of that platform is intended to receive any appropriate load, for example, a single object or a number of individual bags or other articles stacked onto the upper surface. A plurality of support blocks are on the lower surface of the platform. These support blocks are spaced apart from each other on the lower surface of the platform, and support the platform and the load received thereon in elevated relation to a ground support surface on which the support blocks rest. The support blocks are mutually spaced apart on the lower surface of the platform, thereby providing a space beneath the platform for inserting the forks of a lift truck or similar lifting apparatus.

The lifting apparatus of the present invention includes a pair of forks that are laterally separated from each other by a selectively-variable distance. Each fork has an upper surface to fit beneath and engage the underside of the pallet platform, when the forks are positioned beneath the lower surface of the platform. Each fork also has a side member extending generally downwardly from the upper surface of the fork. These side members of the forks are in confronting relation with a facing downwardly-extending surface of a respective support block confronting the fork.

The forks are mounted for selective mutually-opposed movement between a proximal separation and a distal separation between the forks. In the position of proximal separation, the lateral separation between the forks permits inserting or withdrawing the forks from beneath the platform, the forks fitting without interference into spaces between the individual support blocks. However, when the forks are positioned beneath the platform and are separated to their position of distal separation, the side member of each fork is displaced into engagement with the confronting downwardly-extending surface of a support block. This distal separation of the forks thus forces the support blocks apart from each other, imparting tension in the flexible yet substantially inelastic platform so as to help support a load thereon when the forks are elevated to raise the pallet. At the same time, the lateral force of the fork side members against the corresponding sides of the support blocks imparts a force moment to those support blocks, thereby maintaining the support blocks in substantially a level attitude when the forks are elevated above the ground. In that manner, the flexible platform and the load carried by that platform remain substantially level as the lifting device transports that pallet from one location to another along the ground.

Stated in somewhat greater detail, the flexible platform preferably is rectangular in overall configuration. The longitudinal extent of the support blocks is substantially parallel with a dimension of the platform. Each support block, in a preferred embodiment, comprises a block of relatively lightweight substantially non-compressible material contained in a sleeve connected to the lower surface of the platform. The sleeves are made of a substantially inelastic flexible material, and that material may be of the same kind as constitutes the platform itself. The support blocks that are contacted by the lift forks are rectangular in lateral cross-section, or also have a fork-confronting side depending in a substantially perpendicular attitude downwardly from the nominal plane of the platform making up the pallet. That alignment of the fork-confronting side provides a maximum transfer of laterally-directed force from the lift forks at their distal extension, into the support blocks to maintain those blocks and the load on the platform in a substantially upright position.

A preferred embodiment of the pallet has a pair of outer support blocks and an intermediate support block. The outer support blocks are located along opposite sides on the lower surface of the platform, and the intermediate support block is substantially midway between the outer support blocks. The support blocks are mutually parallel, and the spacing between each outer support block and the intermediate support block defines a channel for receiving a fork of the lifting mechanism.

Empty pallets according to the present invention are easily foldable for storage or for return shipment and reuse. The extent of the flexible platform between adjacent support blocks is sufficient to allow folding the empty pallet so that the support blocks are stacked one atop the other. Several pallets folded in that manner may be clustered together and tied in place by a suitable wrap surrounding the cluster. If the cross-sectional dimensions of the support blocks are appropriately selected, a cluster or bundle of several folded pallets meets the maximum-size requirements for mailing the clustered pallets via the postal service to a point of origin. In that manner, empty pallets are easily and inexpensively returnable for reuse, without need to accumulate the pallets until a substantial truckload is on hand.

Further details of the present invention, as well as other objects and advantages thereof, will become more apparent from the following description of a preferred embodiment.

DETAILED DESCRIPTION OF PREFERRED EMBODIMENT

Figure 1:
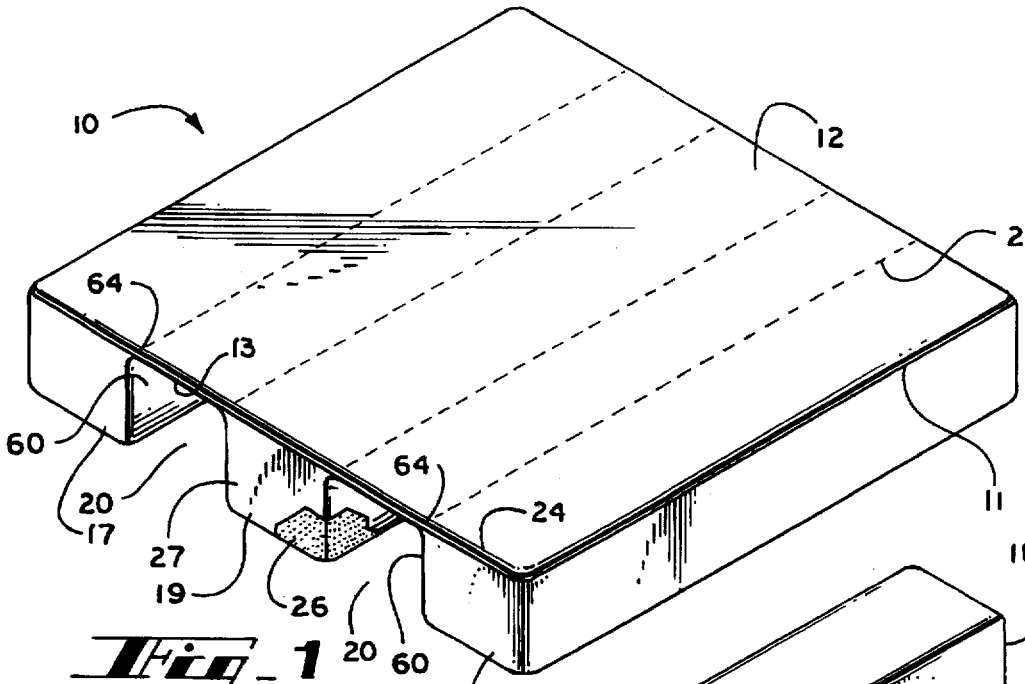
FIG. 1 is a pictorial view, partially broken away for illustration, showing a foldable pallet according to a preferred embodiment of the present invention.

Turning first to FIG. 1, a foldable pallet according to a preferred embodiment of the present invention is shown at 10. The foldable pallet has a platform 11 of generally rectangular overall shape, having a flat upper surface 12 to receive a load and having a lower surface 13. Outer support blocks 17 and 18 are attached to the lower surface 13 of the platform along two opposite sides of the platform. An intermediate support block 19 is attached to the lower surface 13 of the platform substantially at a midpoint between the two outer support blocks. All three support blocks are mutually parallel, and the outer support blocks 17, 18 are spaced apart from the intermediate support block 19 so as to provide the longitudinal hollow spaces 20 between each outer support block and the intermediate support block. These spaces 20 preferably extend along the entire length of the pallet 10. The two outer support blocks and the intermediate support block maintain the platform 11 spaced a distance above a surface 13, FIG. 3, on which the pallet rests.

The platform 11 is fabricated of a flexible but substantially inelastic material, such as canvas or another kind of cloth having suitable strength and resistance to wear. The platform may be a single sheet of such material or may be built up of two or more sheets for greater load-beating strength. For example, the platform 11 may be fabricated from a woven geotextile material having a resistance to puncturing and having sufficient tensile strength to meet the design requirements for a maximum load placed on the pallet, as discussed below. Where the platform comprises more than one ply of material, the multiple plies are interconnected by stitching or other suitable techniques around the periphery 24 of the platform.

Each of the support blocks 17–19 in the preferred embodiment comprises a block 26 of a relatively lightweight, crush-resistant material encased within a flexible pocket 27 that may be made of the same material as the platform 11, or of a single ply of a multi-ply platform material. The blocks 26 in a preferred embodiment are fabricated of an expanded rigid polystyrene plastic of a kind sold under the trademark Styrofoam. The pockets 27 locate the blocks 26 in parallel relation with each other on the lower surface 13 of the platform, and also protect those blocks from damage due to direct contact with the ground surface 20 or the forks of a lifting apparatus. Each pocket 27 is attached to the lower surface 13 of the platform 11 by stitching, in the preferred embodiment. This stitching extends along each end of the respective support blocks, and also extends longitudinally from one end of the platform 11 to the other end, forming lines 28 of stitching that also help bind together the several plies of a multi-ply platform 11. Each block 26 preferably is a loose fit within the corresponding pocket 27. This loose fit reduces the need for exacting manufacturing tolerances when stitching the pockets to the platform 11, and also allows the blocks to undergo a limited extent of self-alignment relative to the forks of a lifting apparatus, as discussed below.

A typical foldable pallet according to the preferred embodiment has a platform 11 with approximately the same length and width as a conventional wooden pallet, although the dimensions of the platform are not a critical part of the present invention. In a specific embodiment, each support block 17–19 is approximately 4 inches high, measured from the ground 20 to the lower surface 13 of the platform 11, and approximately 8½ inches wide as measured from side to side of the support block. The support blocks of that embodiment extend along the entire length of the platform 11. An actual foldable pallet according to the present invention and having the foregoing dimensions weighs approximately 10 pounds when unloaded.

Figure 5:
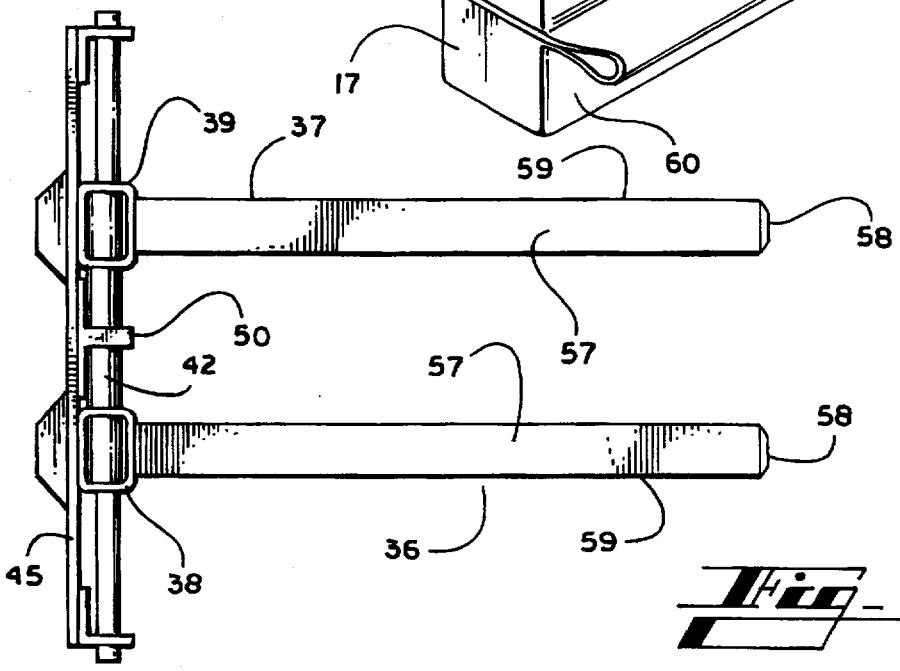
FIG. 5 is a top plan view showing the forks of the lifting apparatus in FIG. 2.
Figure 2:
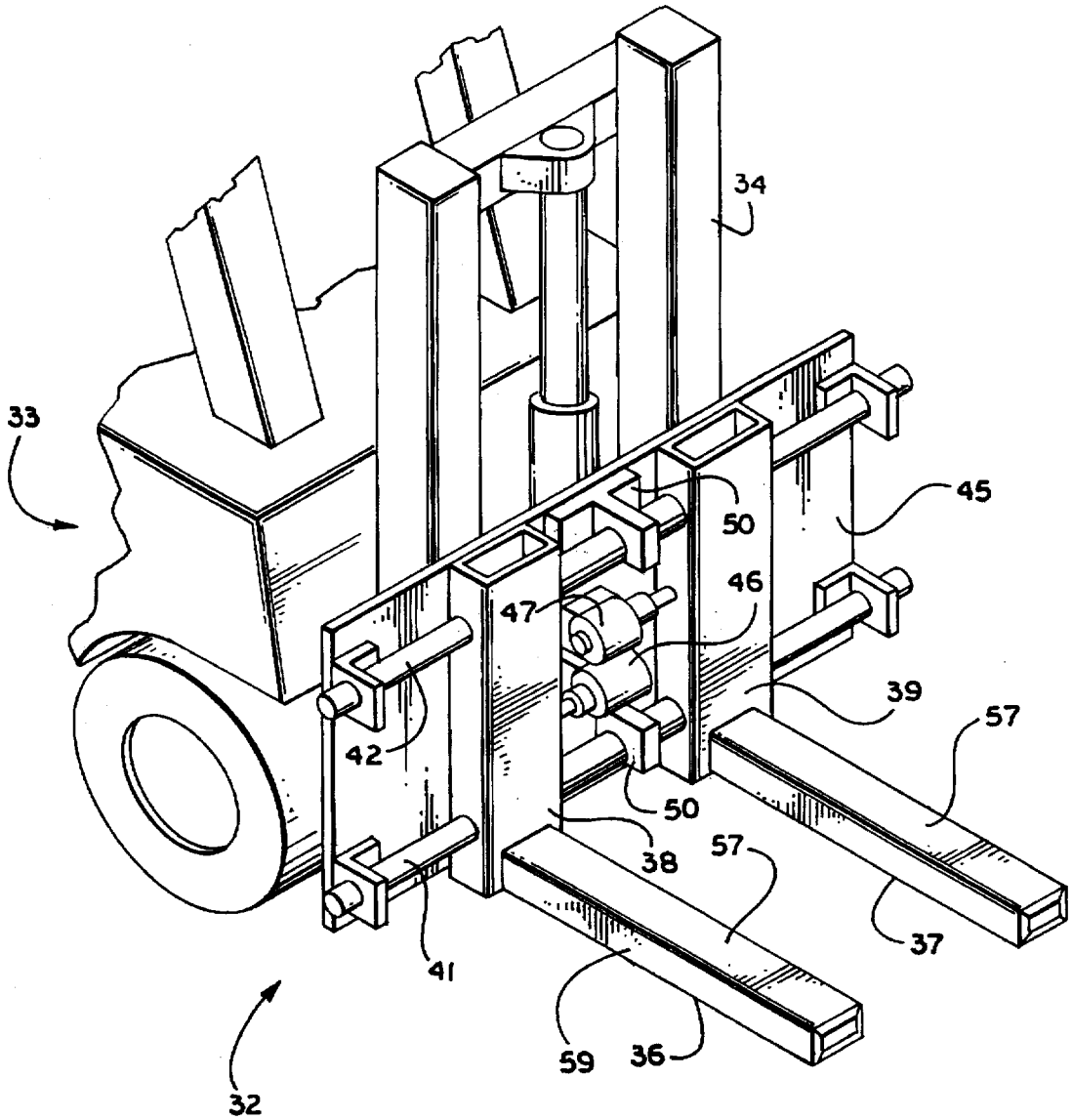
FIG. 2 is a fragmentary pictorial view showing a lift truck equipped with lifting apparatus according to a preferred embodiment of the present invention.
Figure 3:
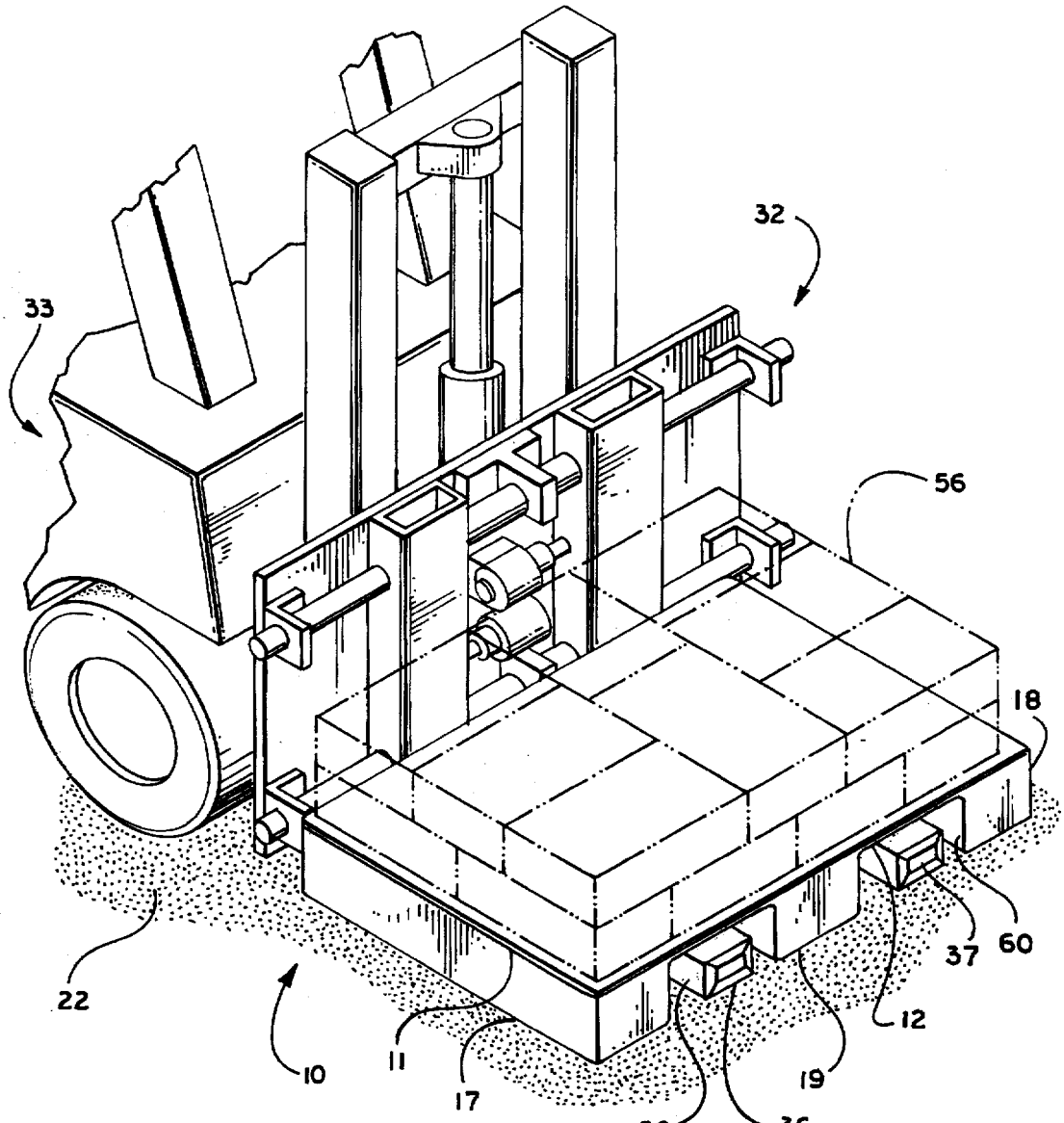
FIG. 3 shows the lift truck of FIG. 2 engaging a pallet as in FIG. 1, with a load shown in phantom on the pallet.
Figure 4:
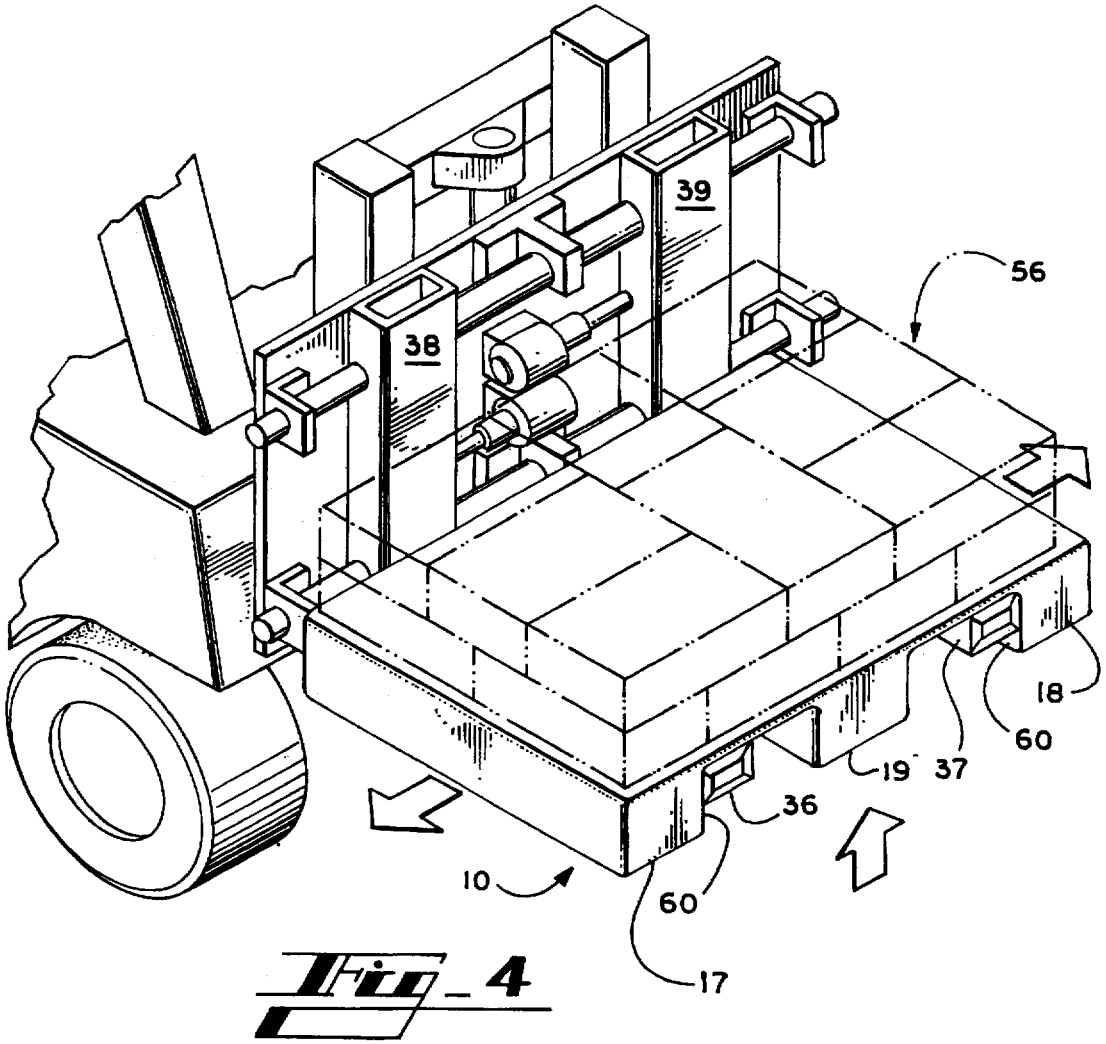
FIG. 4 is a pictorial view as in FIG. 3, with the lift forks separated laterally to engage the pallet and lifted to raise the pallet above the ground.

The lifting apparatus in the disclosed preferred embodiment is best seen in FIGS. 2 and 5, and the application of that apparatus to lifting the foldable pallet is shown in FIGS. 3 and 4. The lifting mechanism is shown generally at 32, and is configured for attachment to a conventional forklift 33 in place of conventional tines or forks, so that the lifting mechanism can be raised or lowered on the boom assembly 34 forming part of the conventional forklift. The lifting mechanism 32 includes a pair of forks 36 and 37 extending forwardly from the lower ends of the respective vertical box-like beams 38 and 39 in approximately a horizontal plane, depending on the extent of the tilt of the boom assembly 34. The beams 38 and 39 are supported for lateral sliding movement on the cross rails 41 and 42 mounted one above the other on the mounting plate 45, which is attached to the conventional lifting mechanism associated with the boom assembly 34. Each cross rail 41, 42 extends through sleeved openings formed in the sides of the box sections 38 and 39, so that each box section can undergo lateral sliding movement along the rails 41 and 42.

The relative lateral positions of the sliding box sections 38 and 39, and thus of the forks 36 and 37, is controlled by the hydraulic cylinders 46 and 47 located between the box sections. The piston rod of the lower hydraulic cylinder 46 is attached to the box beam 38, and the piston rod of the upper hydraulic rod 47 is attached to the box beam 39. The two cylinders 46 and 47 are hydraulically connected in series with a suitable source of hydraulic pressurized fluid, such as the hydraulic system associated with the forklift 33, so that the piston rods of the cylinders are extended or contracted in unison when a forklift operator supplies hydraulic fluid to the respective sides of the cylinders. Such hydraulic connections are well within the skill of the art and need not be explained further herein. This selective actuation of the hydraulic cylinders thus traverses the box sections 38 and 39 in mutually opposed lateral movement along the sliding track provided by the cross rails 41 and 42. When the piston rods of both cylinders 46 and 47 are fully contracted, as shown in FIGS. 2 and 3, the box sections 38 and 39 are drawn together toward each other to a relatively proximal separation as shown in those figures. When the piston rods are mutually extended to the position shown in FIG. 4, the box sections are pushed apart from each other to a distal separation. The forks 36 and 37 likewise are moved relatively closer or relatively farther apart from each other, in response to the contraction or extension of the hydraulic cylinders.

A pair of center supports 50 attach to the front side of the mounting plate 50 and engage the cross rails 41 and 42, approximately in vertical alignment above and below the hydraulic cylinders 46 and 47. These center supports 50 provide midpoint support for the cross rails and help transfer to the mounting plate 45 the weight of the pallet 10 supported by the forks 36 and 37.

The operation of the present invention is best understood with reference to FIGS. 3 and 4. Because the empty pallets are relatively lightweight and can be folded onto themselves, as described below, one person should be able to place and unfold the pallet 10 at a suitable location for receiving a load 56 on the pallet. That load is depicted as a group of individual bags or boxes cross-stacked on the upper surface 12 of the pallet 10, although it should be understood that the pallet is not limited to receiving and supporting loads of that kind. The two outer support blocks 17 and 18, and the intermediate support block 19, support the platform 14 and the load 56 in elevated relation above the surface 22 on which the pallet 10 rests. The weight of the load 56 may cause the flexible platform 11 to undergo a slight amount of sag over the channels 20 separating the adjacent support blocks 17–19 and 18–19, depending on the nature of the individual load articles and the placement of those articles on the pallet. The width of each channel 20, which preferably is less than the corresponding width of each support block, prevents the unsupported portions of the platform 11 from sagging to an extent that would interfere with placement of the lift forks 36, 37 into those channels.

To move the loaded pallet 10 from place to place, the forklift 33 is maneuvered to insert the forks 36 and 37 into the channels 20 beneath the lower surface 13 of the pallet. At this time, the hydraulic cylinders 46 and 47 are retracted, placing the forks 36 and 37 at their minimum lateral separation relative to each other. If the forklift 33 is so equipped, the forklift operator may translate the entire lifting mechanism 32 from side to side as necessary for aligning the forks with the channels 20. Once the forks are aligned with the channels, the forklift operator drives forward so that the forks move into the channels. The forward ends 58 of each fork 36, 37 preferably are formed with a domed or rounded shape as best seen in FIG. 5, to assist the forks in entering the channels 20.

Once the forklift operator has the forks 36, 37 fully placed in the channels 20 of the pallet, the operator actuates the hydraulic cylinders 46, 47 to separate the box sections 38, 39 along the cross rails 41, 42, thereby also separating the forks 36, 37 from each other. As the forks move apart, the outwardly-facing vertical side member 59 of each fork moves into contact with the confronting side 60 of each outer support blocks 17 and 18. Those confronting sides 60 of the support blocks depend downwardly from the lower surface 13 of the platform 11 making up the foldable pallet, and when the pallet is in load-receiving condition as shown in FIG. 1, those surfaces 60 thus depend downwardly from the platform 11 at substantially a right angle to the lower surface 13 of that platform. When the forks 36, 37 arrive at their maximum relative separation from each other, the outward side member 59 of each fork thus has moved into firm abutting contact with the depending side 60 of each outer support block.

With the forks thus laterally extended from each other, the forklift operator can raise the lifting mechanism of the boom assembly 34 to elevate the forks and the pallet 10 above the surface 22 on which the pallet formerly rested. As the forks 36 and 37 are raised, the top members 57 of those forks move into contact with the lower surface 13 of the pallet within the channels 20. The top members 57 of the fork thus provide direct support for that portion of the load 56 disposed on the upper surface 12 directly above each fork. At the same time, the side members 59 of the forks impart to the outer support blocks a lateral force that imparts a moment to each support block, acting along a center of rotation parallel to the outer support block and located approximately at the upper edge of each depending side 60, where that upper edge is joined to the lower surface 13 of the pallet platform 11. This moment of force is of equal magnitude and opposite direction to the moment exerted on the particular support block by the weight of the load 56 acting downwardly on the support block. The laterally-separated forks 36, 37 thus maintain the support blocks 17, 18 substantially in an upright position as shown in FIG. 4, although the forks do not extend beneath the support blocks. The upper surface 12 of the pallet thus remains substantially level as the pallet is lifted and transported by the forklift 33.

The intermediate support block 19 remains unsupported by either fork as the forks raise the pallet 10 off the surface 22. However, the opposed lateral forces applied to the outer support blocks 17 and 18 by the forks applies lateral tension to the nonresilient platform 11 keeping that platform taut so that the intermediate support block 19 and the load acting downwardly on that support block (that is, the load located between the top members 57 of the forks) sags at most only a limited extent relative to the remainder of the platform 11, so as not to disturb the load 56 stacked on that platform.

Once the forklift operator has repositioned the pallet 10 and its load to a desired location, the operator lowers the lifting mechanism of the forklift to place the support blocks 17–19 onto a new support surface. The operator then actuates the hydraulic cylinders 46, 47 to move the forks 36, 37 toward each other, so that the forks move out of contact with the depending sides 60 of the adjacent outer support blocks. The forklift operator then reverses the forklift away from the pallet, withdrawing the forks from the channels 20 of the pallet.

Although the lifting mechanism 37 is shown attached to a forklift, it should be understood that the lifting mechanism is adaptable to other vehicles. For example, a lifting mechanism according to he present invention can be adapted to a manual or power-driven tug or truck for moving the pallets from place to place in a warehouse or other facility.

Figure 6:
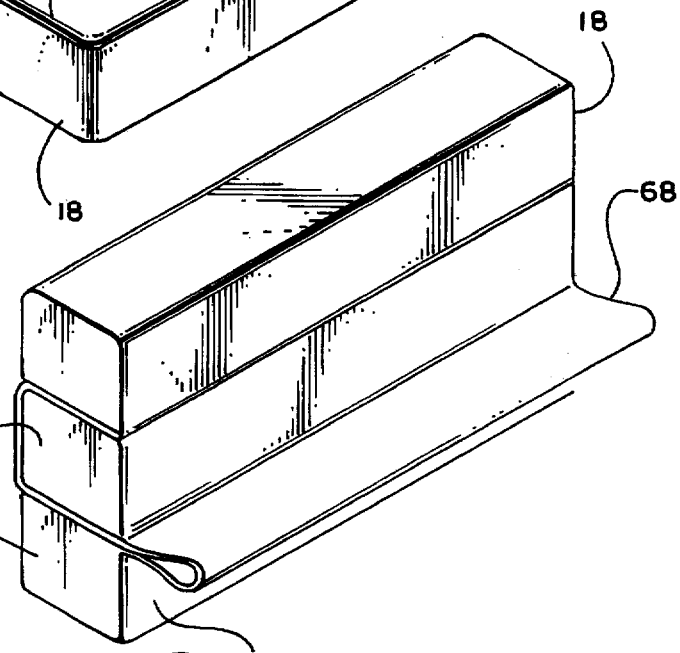
FIG. 6 is a pictorial view showing the pallet of FIG. 1 folded for storage or shipment.

When the load 56 is removed from a pallet 10 according to the present invention, that pallet is readily folded to occupy substantially less volume and floor space. FIG. 6 illustrates the folded position of the pallet. By comparing the folded pallet shown in that figure with the same pallet shown in FIG. 1 unfolded for use, it will be understood that the intermediate support block 19 has been rotated 180° and moved leftwardly to rest on top of the outer support block 17. That portion of the flexible platform 11 extending between the outer support block 17 and the intermediate support block 19 forms a loose fold 68 extending outwardly from between those two support blocks. With the outer support block 17 and the intermediate support block 19 thus positioned, the other outer support block 18 next is turned approximately 180° clockwise (as viewed in FIG. 6) so that the upturned bottom of the intermediate support block receives the bottom of that other outer support block. The resulting package formed by the folded pallet 10 is substantially the width of a single support block and the height of the three support blocks stacked on top of each other. This folded pallet, being relatively light of weight, is easily carried from place to place under a person's arm. If desired, the folded pallet can be surrounded by a suitable wrap or band to hold the pallet in its folded configuration.

Still another advantage of the foldable pallet is derived from the relatively small volume occupied by the pallet in its folded configuration as shown in FIG. 6. Depending on the length and height of the individual support blocks, it is feasible to configure the folded pallets so that several such pallets, when folded as shown in FIG. 6, can be placed alongside each other and wrapped or banded together, forming a package within the maximum volume or cubage limits for shipment by parcel post or by commercial parcel shipping services. With foldable pallets so dimensioned and relatively light of weight, empty pallets according to the present invention are readily and inexpensively returnable to a point of origin by shipping as parcels, instead of collecting empty pallets until a sufficient number is on hand for return by truck to the shipper as in the prior art. Foldable pallets according to the present invention thus may be returned for reuse without delay, so that fewer pallets need be deployed in the round-trip pipeline from the shipper to the customer and return to the shipper. Reducing the shipper's investment in pallets reduces the overall cost of the goods being shipped, and makes the producer of the goods more competitive in the marketplace.

It should be understood that the foregoing relates only to a preferred embodiment of the present invention, and that numerous changes and modifications therein may be made without departing from the spirit and scope of the invention as defined in the following claims.

I claim:

1. A foldable and reusable soft pallet intended for supporting a load and moving the load by means of a lifting mechanism having a pair of laterally-separated forks, each fork having a top member and a side member extending downwardly from the top member, and the lateral separation between the forks being selectably variable between a proximal separation and a distal separation, the pallet comprising:

a flexible platform formed of flexible textile material and having an upper surface operative to receive the load;

first and second support blocks affixed in laterally spaced apart relation on a lower surface of the flexible platform to support the flexible platform and a load received thereon in elevated relation to a ground surface when the support blocks rest on the ground surface;

at least one other support block affixed on the lower surface of the flexible platform, the other support block extending between and parallel to the first and second support blocks so as to further support the flexible platform and the load in elevated relation to the ground surface, with the other support block laterally spaced apart from the first and second support blocks to define elongated regions for receiving the forks in proximal separation beneath the lower surface of the flexible platform without interference with the support blocks;

the first and second support blocks each having a side face depending from the lower surface of the flexible platform and facing the respective fork-receiving regions so that distal separation of the forks in said regions engages the side faces by the confronting side members of the forks and urges apart the first and second support blocks, thereby applying lateral tension to the flexible platform sufficient to support the load thereon when the forks lift the pallet above the ground surface and applying a force moment to the first and second support blocks sufficient to maintain said support blocks substantially level when the pallet is lifted;

the flexible platform having tensile strength sufficient to withstand the lateral tension applied thereto by the first and second support blocks while supporting a predetermined load;

the flexible platform being sufficiently flexible to permit nondestructive folding intermediate the support blocks without weakening the flexible platform for subsequent unfolding and reuse, so that the support blocks rest approximately one alongside the other, thereby substantially reducing the overall size of the folded pallet for shipping or storing; and the textile material of the flexible platform having sufficient tensile strength to withstand said lateral tension.

2. The soft pallet as in claim 1, wherein the support blocks are contained in corresponding sleeves connected to the lower surface of the textile material comprising the flexible platform.

* * * * *